US011993434B2

(12) United States Patent
Hoefte et al.

(10) Patent No.: US 11,993,434 B2
(45) Date of Patent: May 28, 2024

(54) DETERGENT PRODUCT CONTAINER

(71) Applicant: The Procter & Gamble Company, Cincinnati, OH (US)

(72) Inventors: Paulus Antonius Augustinus Hoefte, Astene (BE); Clara Sophie Lea Ng Pak Leung, Ixelles (BE); Joost Peter Leflere, Mechelen (BE); Robby Renilde Francois Keuleers, Lippelo (BE)

(73) Assignee: The Procter & Gamble Company, Cincinnati, OH (US)

( * ) Notice: Subject to any disclaimer, the term of this patent is extended or adjusted under 35 U.S.C. 154(b) by 57 days.

(21) Appl. No.: 18/079,929

(22) Filed: Dec. 13, 2022

(65) Prior Publication Data

US 2023/0110630 A1 Apr. 13, 2023

Related U.S. Application Data

(63) Continuation of application No. PCT/US2021/040980, filed on Jul. 9, 2021.

(30) Foreign Application Priority Data

Jul. 9, 2020 (EP) ..... 20185103

(51) Int. Cl.
*B65D 5/68* (2006.01)
*B65B 5/02* (2006.01)
(Continued)

(52) U.S. Cl.
CPC ..... *B65D 5/68* (2013.01); *B65B 5/024* (2013.01); *B65B 7/28* (2013.01); *B65D 5/443* (2013.01); *B65D 65/403* (2013.01); *B65D 85/70* (2013.01)

(58) Field of Classification Search
CPC ..... B65D 5/685; B65D 5/02; B65D 5/563; B65D 5/106; B65D 5/6667; B65D 5/38;
(Continued)

(56) References Cited

U.S. PATENT DOCUMENTS 3,366,496 A 1/1968 Bomar et al.
4,420,924 A 12/1983 Hoyrup et al.
(Continued)

FOREIGN PATENT DOCUMENTS

EP 0074673 A1 3/1983
EP 3587293 A1 1/2020
(Continued)

OTHER PUBLICATIONS

All Office Actions; U.S. Appl. No. 18/079,939, filed Dec. 13, 2022.
(Continued)

*Primary Examiner* — Javier A Pagan
(74) *Attorney, Agent, or Firm* — Gregory S. Darley-Emerson; George H. Leal

(57) ABSTRACT

A consumer product that includes a detergent product and a container, particularly containers that include corrugated fiberboard, where the container includes a box and a lid, the lid having a top panel and flanks, and the flanks have a first flank corresponding to a first side of the lid from a first flank corner to a second flank corner, the first flank having a first major flap that includes a first flank corrugated fiberboard layer. Methods of making and using such products and containers.

21 Claims, 7 Drawing Sheets

(51) Int. Cl.

| | |
|---|---|
| ***B65B 7/28*** | (2006.01) |
| ***B65D 5/44*** | (2006.01) |
| ***B65D 65/40*** | (2006.01) |
| ***B65D 85/00*** | (2006.01) |

(58) Field of Classification Search
CPC .... B65D 5/6673; B65D 5/6632; B65D 5/667; B65D 5/4608; B65D 5/2057; B65D 5/22; B65D 5/541; B65D 5/6664; B65D 5/643; B65D 81/264; B65D 2543/00268; B65D 2543/00537; B65D 2543/00534; B65D 59/04; B65D 77/04; B65D 83/04673; B65D 43/0222
See application file for complete search history.

(56) References Cited

U.S. PATENT DOCUMENTS

| | | | | |
|---|---|---|---|---|
| 5,450,998 | A | 9/1995 | Esse et al. | |
| 5,494,161 | A * | 2/1996 | Herbst | B42F 15/0094 206/425 |
| 6,484,478 | B1 | 11/2002 | Arends et al. | |
| 6,484,479 | B1 | 11/2002 | Minion | |
| 6,604,676 | B2 * | 8/2003 | Giblin | B65D 5/543 229/148 |
| 9,783,335 | B2 | 10/2017 | Everett | |
| 9,881,788 | B2 | 1/2018 | Kim et al. | |
| 9,994,355 | B2 | 6/2018 | Ishikawa et al. | |
| 10,017,291 | B2 | 7/2018 | Smith et al. | |
| 10,934,072 | B2 | 3/2021 | Lantz et al. | |
| 11,530,058 | B2 | 12/2022 | Jonker et al. | |
| 11,667,411 | B2 | 6/2023 | De Jong et al. | |
| 11,794,947 | B2 | 10/2023 | Hoefte et al. | |
| 2003/0111523 | A1 | 6/2003 | Haugan | |
| 2017/0001752 | A1 | 1/2017 | Ishikawa et al. | |
| 2017/0036808 | A1 * | 2/2017 | Everett | B65D 5/6664 |
| 2018/0257827 | A1 | 9/2018 | Drosos et al. | |
| 2019/0062023 | A1 | 2/2019 | Lantz et al. | |
| 2021/0047072 | A1 | 2/2021 | Ng Pak Leung et al. | |
| 2021/0237914 | A1 | 8/2021 | Jonker et al. | |
| 2022/0009671 | A1 | 1/2022 | Hoefte et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2022/0380086 | A1 | 12/2022 | Hoefte et al. | |
| 2023/0132541 | A1 | 5/2023 | Hoefte et al. | |
| 2023/0257141 | A1 | 8/2023 | Ruers et al. | |
| 2023/0257145 | A1 | 8/2023 | Ruers et al. | |
| 2023/0264852 | A1 | 8/2023 | Hoefte et al. | |
| 2023/0264853 | A1 | 8/2023 | Hoefte et al. | |
| 2023/0286695 | A1 | 9/2023 | Hoefte et al. | |
| 2023/0322455 | A1 | 10/2023 | Beelen et al. | |
| 2023/0331447 | A1 | 10/2023 | Hoefte et al. | |
| 2024/0002100 | A1 | 1/2024 | Hoefte et al. | |

FOREIGN PATENT DOCUMENTS

| | | | |
|---|---|---|---|
| EP | 3753856 | A1 | 12/2020 |
| EP | 3936451 | A1 | 1/2022 |
| FR | 2820718 | A1 | 8/2002 |
| IT | BO20100425 | A1 | 12/2011 |
| JP | 4536881 | B2 | 6/2010 |
| WO | 2017033210 | A1 | 3/2017 |
| WO | 2018022493 | A1 | 2/2018 |

OTHER PUBLICATIONS

PCT Search Report and Written Opinion for PCT/US2021/040980 dated Sep. 30, 2021, 13 pages.
Extended EP Search Report and Written Opinion for 20185103.7 dated Dec. 1, 2021, 07 pages.
U.S. Appl. No. 18/079,939, filed Dec. 13, 2022, to Paulus Antonius Augustinus Hoefte et al.
All Office Actions; U.S. Appl. No. 18/096,172, filed Jan. 12, 2023.
U.S. Appl. No. 18/096,172, filed Jan. 12, 2023, to Henri Theo Leonie Ruers et al.
All Office Actions; U.S. Appl. No. 18/506,351, filed Nov. 10, 2023.
U.S. Appl. No. 18/506,351, filed Nov. 10, 2023, Henri Theo Leonie Ruers et al.

* cited by examiner

DETERGENT PRODUCT CONTAINER

FIELD OF THE INVENTION

The present disclosure generally relates to a consumer product that includes a detergent product and a container, particularly containers that include corrugated fiberboard. The present disclosure further relates to methods of making and using such products and containers.

BACKGROUND

Detergent products are widely used by consumers and should be appropriately packaged to permit shipping to a point of sale, storage in a point of sale, transport to a consumer home and storage in a consumer home while limiting impact to a quality of the detergent product, and risks of contamination during transport or storage. Detergent products are therefore packaged in specific containers, such specific containers protecting the detergent product from external nuisance, and protecting the environment from contamination by the detergent product.

SUMMARY OF THE INVENTION

The present disclosure relates to consumer products that include a detergent product and a container.

For example, the present disclosure relates to consumer products that include a detergent product and a container, the container containing the detergent product, the container comprising a box and a lid, the lid comprising a top panel and flanks, the flanks comprising at least a first flank, the first flank corresponding to a first side of the lid from a first flank corner to a second flank corner, the first flank corner connecting the first flank with a second flank of the flanks, the second flank corner connecting the first flank with a third flank of the flanks, the first flank comprising a first major flap, the first major flap comprising a first flank corrugated fiberboard layer, the first flank corrugated fiberboard layer being connected by a first flank fold line to the top panel, the first flank corrugated fiberboard layer comprising first flank flutes, each first flank flute running along a first flank flute length parallel to the first flank fold line, each first flank flute forming a channel in communication with an external environment outside of the lid at a first first flank flute end and at a second first flank flute end.

The present disclosure further relates to method of making and using such consumer products and/or containers.

DETAILED DESCRIPTION

This disclosure relates to a consumer product comprising a detergent product and a container, the container containing the detergent product, the detergent product preferably comprising water soluble unit dose articles. Detergent products, and more specifically water soluble unit dose articles, are particularly sensitive to humidity and should be well protected from humidity by the container. The container should also avoid or reduce risks of the detergent product leaking out of the container and contaminating an environment outside of a container. While such aspects may be handled for example by using containers made of plastic resins, such containers made of plastic resins are not as environmentally friendly as corrugated fiberboard containers. Corrugated fiberboard containers also tend to be recycled more frequently than plastic resin containers. Recycling should be understood as comprising one or more of containers being collected, sorted, reprocessed and/or reused. Corrugated fiberboard containers are however more likely to get damaged by humidity, even more so in humid environments such as a laundry room or a kitchen sink drawer at an end consumer home. The present disclosure aims at improving the resistance of corrugated fiberboard containers in order to prevent or reduce deteriorating the properties of corrugated fiberboard in a humid environment, thereby permitting the use of containers made of corrugated fiberboard to contain a detergent product, particularly in the form of water soluble unit dose articles.

This disclosure proposes a specific lid structure in which specific flutes of corrugated fiberboard are forming a channel in communication with an external environment outside of the lid, such that these flutes may channel an air flow which contributes to aerating the flutes and maintaining the protective properties of the corrugated fiberboard material. Such a structure will avoid or reduce humidity sitting or being retained in these flutes, leading to deterioration of their structure. Such a structure will also avoid or reduce the risk of humidity being channeled by such flutes from the external environment to a volume covered by the lid.

In addition to avoiding or reducing a risk of damaging the lid structure by lack of ventilation, such a structure comprising apparent flute ends permits easing the identifying of the type of material used for the lid, thereby permitting that an end consumer may chose a container comprising an environmentally friendly material such as corrugated fiberboard.

A structure as disclosed whereby the first flank corrugated fiber board layer of the first major flap is exposed to the external environment also permits using such first flank corrugated fiber board layer to display information printed on a flat, continuous surface of the first flank corrugated fiber board layer facing the external environment, such information comprising for example instructions to dismount the container.

Figure 1:
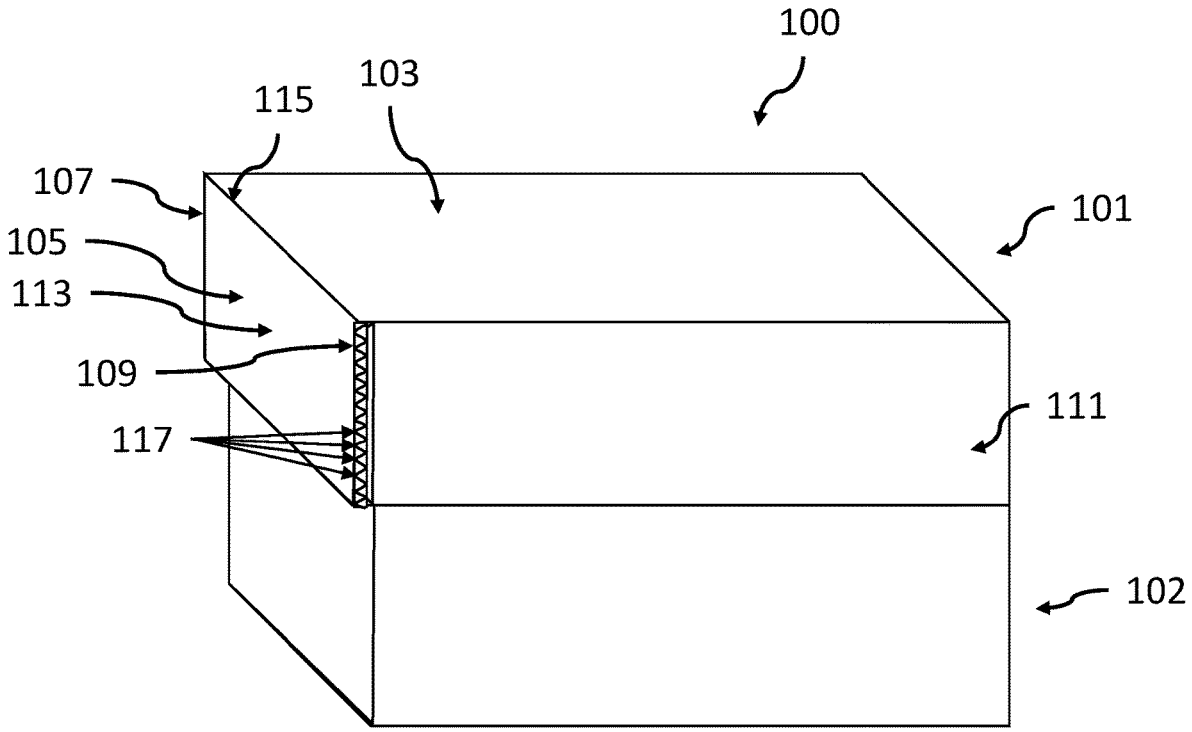
FIG. 1 illustrates an example consumer product.

FIG. 1 illustrates an example consumer product 100 according to this disclosure. A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be designed taking manufacturing efficiency into account. Consumer products should also be designed taking on the shelf storage in a retail store into account. Consumer products should also be designed taking transportation from a retail store to a consumer home into account. Consumer products should also be designed taking storage at a private end consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. The detergent product comprises in some examples water soluble unit dose detergent pouches, more preferably flexible water soluble unit dose detergent pouches. Example water soluble unit dose detergent pouches are described in more detail herein.

The consumer product comprises the detergent product and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves, shrink wrap or labels attached to the container. Alternatively, the container may be coloured or printed with aesthetic elements or informative print such as usage instructions.

The consumer product according to this disclosure further comprises a container containing the detergent product. A container should be understood in this disclosure as an object housing a content, for example in a cavity of the container. The container facilitates protection, transport, storage, access and disposal of the consumer product.

In this disclosure, the container comprises a box. A box should be understood as a generally parallelepiped, barrel shaped, cylindrical, round, oval or cubical three dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box. The box according to this disclosure may comprise a base, sidewalls and an opening. A base according to this disclosure should be understood as a surface on which the box may lie when placed on a supporting surface such as a shelf or a floor. In some examples, the base is flat. In some examples, the base is rectangular. In some examples, the base is oval or round. In some examples, the base is non flat. In some examples, the base has an embossed profile standing in or out in relief. The sidewalls according to this disclosure should be understood as extending from the base, and connecting the base to the opening, to a transition piece or to the lid. It should be understood that the connection of the base to the opening may include a transition piece in addition to a sidewall. A transition piece may be glued or otherwise attached to the sidewall for example. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples the base is oval or circular and the sidewalls form a generally cylindrical wall extending from the base in a direction normal to or perpendicular to the base. In some examples, sidewalls have a shape corresponding to one of a square, a rectangle, a trapeze, a section of a sphere, a section of an ovoid, or a section of an ellipsoid. The opening according to this disclosure should be understood as an aperture providing access to the detergent product comprised in the box. In some examples, the opening faces the base. In some examples, the opening has a surface of less than the surface of the base. In some examples, the opening has a surface larger than the surface of the base in order to provide an improved access, for example using sidewalls extending from the base at an angle of more than 90 degrees from the base. In some examples, the opening is provided after removal of a tamper proof feature, for example comprising a perforated piece to be removed at first use or a tamper evident sticker locking the lid to the box or tray. In some examples, the opening is placed on a top panel of the box, the top panel of the box facing the base of the box, the top panel of the box being separated from the base of the box by at least the sidewalls, the top panel of the box being generally coplanar with the base of the box, whereby the opening covers a portion of the top panel, the top panel comprising a peripheral section surrounding the opening, the peripheral section being a transition piece between a sidewall and the opening for example. In some examples, the opening is rectangular. In some examples, the opening is rectangular with rounded edges. In some examples, the opening is round or oval. In an example, the container is made from cardboard materials and is thereby made from materials which may be recycled, more specifically recycled in a paper or cardboard recycling stream, even more specifically in a paper or cardboard recycling stream comprising less than a predetermined threshold of non fiber material, for example less than 5% by weight of non fiber material. In some examples, the opening is hexagonal or octagonal with bevelled edges.

In this disclosure, the container comprises a lid. The lid according to this disclosure should be understood as an element permitting to repeatedly close or open an opening of the box. In some examples the lid may be connected to the box, for example by a hinge, or may be separated from the box. The lid according to this disclosure may comprise a top and flanks. It should be understood that the top of the lid is aimed at covering the opening of the box when the lid is in a closed position. In some examples, the top of the lid is rectangular. In some examples the top of the lid is round, hexagonal, octagonal, or oval. In some examples, the lid comprises beveled edges. In some examples, the top of the lid is rectangular with rounded edges. It should be understood that while being named "top", the top of the lid may be positioned in different orientations. The lid may comprise flanks. It should be understood that the flanks according to this disclosure are elements connected to the top of the lid and extending from the lid in order to engage one or more sidewalls of the box. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flankless. The top of the lid may cover the opening, and at least a portion of the flanks may cover at least a specific portion of the sidewalls of the box when the lid is in the closed position, the lid being moveable from the closed position to an open position. Movement of the lid may be restrained by a connection to the box such as a hinge, or may be entirely removable, for example to provide an improved access to the content of the box. The box and lid cooperate to participate in fulfilling the role of the container to store, transport, protect and facilitate access to the content of the container.

In some examples the flanks of the lid cover about 30% of the sidewalls of the box, 30% corresponding in this case to a ratio between on one hand a height of the flanks in a direction normal to both the top of the lid and the base of the box and on the other hand the height of the sidewalls in the direction normal to both the top of the lid and the base of the box. In an example, the flanks completely surround the sidewalls around the opening. Such coverage of the flanks participates in ensuring lid placement, structural resiliency and protection of the content. In some examples, the flanks cover at least 30% of the sidewalls when the lid is in the closed position. In some examples, the flanks cover at least 35% of the sidewalls when the lid is in the closed position. In some examples, the flanks cover at least 40% of the sidewalls when the lid is in the closed position. In some examples, the flanks cover at most 90% of the sidewalls when the lid is in the closed position. In some examples, the flanks cover at most 80% of the sidewalls when the lid is in the closed position. In some examples, the flanks cover at most 70% of the sidewalls when the lid is in the closed position. In some examples, a manufacturing process comprises providing different box sizes, for example boxes having a sidewall height of either 10 cm, 11.5 cm, 13.5 cm or 16 cm, whereby each box may be provided with a same lid fitting all box sizes provided, such as a lid having a flank height of 7 cm. In some examples, flank height is of more than 3 cm. In some examples, flank height is of more than 5 cm. In some examples, flank height is of more than 6 cm. In some examples, a set of different lid sizes may be provided to fit on different box sizes.

The container may be made from rigid cardboard material, flexible cardboard material or a mixture thereof. In some example, the material forming the box or the lid has a wall thickness of more than 300 microns and of less than 3 mm. In some example, the material forming the box or the lid has a wall thickness of more than 1 mm and of less than 2 mm. In some example, the material forming the box or the lid is folded on itself, for example to reinforce parts of or the whole of the box or the lid. In some examples, a reinforced panel, wall or flank comprises a double layer of the material forming the box or the lid, such double layer altogether having for example a thickness of less than 6 mm, more preferably of less than 4 mm most preferably more than 2 mm and less than 4 mm. The container may be made from paper materials, cellulose based material, bio based material, bamboo fibres, cellulose fibres, cellulose based fibres, recycled cellulose fibres, laminated material (comprising for example a PE, polyethylene, layer), or a mixture thereof. The container may be made from materials comprising recycled materials.

The consumer product 100 comprises a container, the container comprising a box 102 and a lid 101. The lid 101 comprises a top panel 103 and flanks, the flanks comprising a first flank 105 corresponding to a first side of the lid from a first flank corner 107 to a second flank corner 109, the first flank corner 107 connecting the first flank 105 with a second flank of the flanks (the second flank is in FIG. 1 in the back of the container and is not visible), the second flank corner 109 connecting the first flank 105 with a third flank 111 of the flanks. In this example, the top panel and each flank are rectangular, the corners being segments.

The first flank 105 comprises a first major flap 113, the first major flap 113 comprising a first flank corrugated fiberboard layer, the first flank corrugated fiberboard layer being connected by a first flank fold line 115 to the top panel 103, the first flank corrugated fiberboard layer comprising first flank flutes 117, each first flank flute 117 running along a first flank flute length parallel to the first flank fold line 115, each first flank flute 117 forming a channel in communication with an external environment outside of the lid 101 towards the first flank corner 107 and towards the second flank corner 109, the channel being, for each flute, from a first first flank flute end to a second first flank flute end.

As illustrated for example in FIG. 1, the lid participates in protecting the detergent product from the external environment, and the lid participates in protecting the external environment from contamination by the detergent product. The flanks of the lid also participate in protecting sidewalls of the box. The flanks of the lid may be considered a first line of protection from humidity present in the external environment. The fact that at least the first flank comprises flutes as per this disclosure permits ventilation of the first flank corrugated fiberboard layer, participating in maintaining the first flank corrugated fiberboard layer dry, such that it may fulfil its protecting function.

The lid, box or container according to this disclosure may be made from paper or cardboard materials wherein the paper material is for example selected from paperboard, cardboard, laminates comprising at least one paper board or cardboard layer, cellulose pulp materials or a mixture thereof. While at least a first flank of the lid comprises flutes as per this disclosure, other materials as hereby described may be optionally used in addition to the first flank of the lid comprises flutes. In some other examples, the lid, box or container is integrally made of a material comprising flutes as per this disclosure. The material used to make the lid, box or container may comprise other ingredients, such as colorants, preservatives, plasticisers, UV stabilizers, Oxygen, perfume, recycled materials, glues, adhesives and moisture barriers, or a mixture thereof. The lid, box or container may comprise areas of external or internal printing. The lid, box or container may be made for example by cardboard making. Suitable cardboard support element, lid, box or container manufacturing processes may include, but are not limited to, tube forming from a flat cardboard or paper sheet with a gluing step, folding or a mixture thereof. The lid, box or container is opaque, for example to protect content from external light. In some examples the lid, box or container is constructed at least in part and in some specific examples in its entirety from paper-based material. By paper-based material, we herein mean a material comprising paper. Without wishing to be bound by theory, by 'paper' we herein mean a material made from a cellulose-based pulp. In some examples, the paper-based material comprises paper, cardboard, or a mixture thereof, wherein preferably, cardboard comprises paper-board, corrugated fiber-board, or a mixture thereof. Corrugated fiber-board comprises a series of flutes. Each flute can be understood to be a channel. The flutes run parallel to one another, with the flute direction being the direction travelled along each channel. The paper-based material may be a laminate comprising paper, cardboard, or a mixture thereof, wherein in some examples, cardboard comprises paper-board, corrugated fiber-board, or a mixture thereof, and at least another material. In some examples, the at least another material comprises a plastic material. In some examples, the plastic material comprises polyethylene, polyethylene terephthalate, polypropylene, polyvinylalcohol, EVOH (copolymer of ethene and vinyl alcohol) or a mixture thereof. A barrier material may be used as the at least another material. The barrier material may be a biaxially orientated polypropylene, a metallised polyethylene terephthalate or a mixture thereof. The at least another material may comprise a wax, a cellulose material, polyvinylalcohol, silica dioxide, casein based materials, adhesives, glues, or a mixture thereof. In some examples, the paper-based laminate comprises greater than 50%, preferably greater than 85%, and more preferably greater than 95% by weight of a laminate of fiber-based materials. In some examples, the barrier material may comprise plastic material having a thickness of between 10 micron and 40 micron. In some examples, the barrier material may comprise plastic material having a thickness of between 10 micron and 35 micron. The paper-based material may be a laminate. In some examples, the internal surface of a lid, box or container comprises paper, cardboard, or a mixture thereof, wherein, in specific examples, cardboard comprises paper-board, corrugated fiber-board and lamination of polyethylene, or a mixture thereof, and, in some examples, the external surface of the support element, lid, box or container or a combination thereof comprises the at least another material. Alternatively, the at least another material might also be laminated in-between two paper-based material layers. Without wishing to be bound by theory this at least another material might act as a barrier for leaked liquid absorbed by the paper-based material facing the interior side of the lid, box or container, to prevent or reduce a contaminating flow through a wall of the lid, box or container. Other structures may be found efficient to avoid leakage from the content or to protect the content from external fluids, for example from a shower, sink or wet hands. Contamination of a wall of the support element, lid, box or container might be unsightly to consumers or may contaminate the storage area. In some examples, the lid, box or container are made of a paper-based material comprising the at least another material laminated in between two corrugated fiberboard layers. In some examples, the material used for the lid, box or container comprises a core cardboard flute material sandwiched between two plain cardboard layers and polyethylene laminate.

The consumer product 100 illustrated in FIG. 1 comprises a single major flap 105 comprising flutes having apertures exposed to the external environment to form the channels as per this disclosure. In other examples, other parts of the lid also comprise such flutes having apertures exposed to the external environment.

The flutes according to this disclosure should be understood as being formed by a core waved cardboard or paperboard layer sandwiched between two planar cardboard or paperboard layers. Such a structure provides an increased flat crush resistance, bending resistance and/or stiffness compared to cardboard or paperboard structures without flutes. Such flat crush resistance participates in protecting the content of the container. The flute structure of the first flank corrugated fiberboard layer according to this disclosure comprises flutes having apertures exposed to the external environment, each flute comprises two flute ends and each flute comprising two of these apertures, one at each flute end, each of such two apertures opening towards, or preferably at, either the first or the second flank corner. Air entering one of the aperture will circulate from flute end to flute end within the channel formed by the flute along a direction parallel to the folding line of the first major flap with the top panel of the lid and exit on the other aperture, collecting residual humidity which may be present within the flute, thereby ventilating the flute and preventing degradation of the first major flap.

Figure 2A:
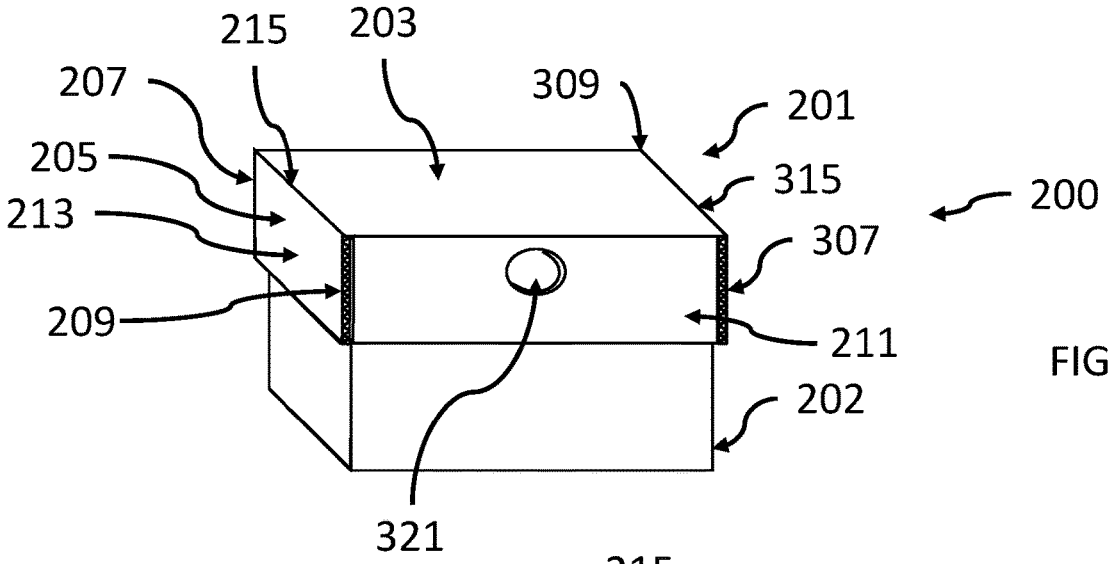
FIG. 2A-C illustrate another example consumer product.
Figure 2B:
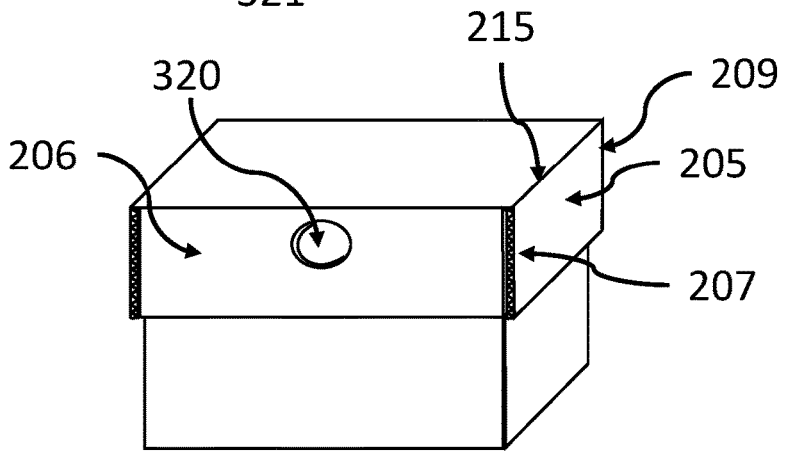
Figure 2C:
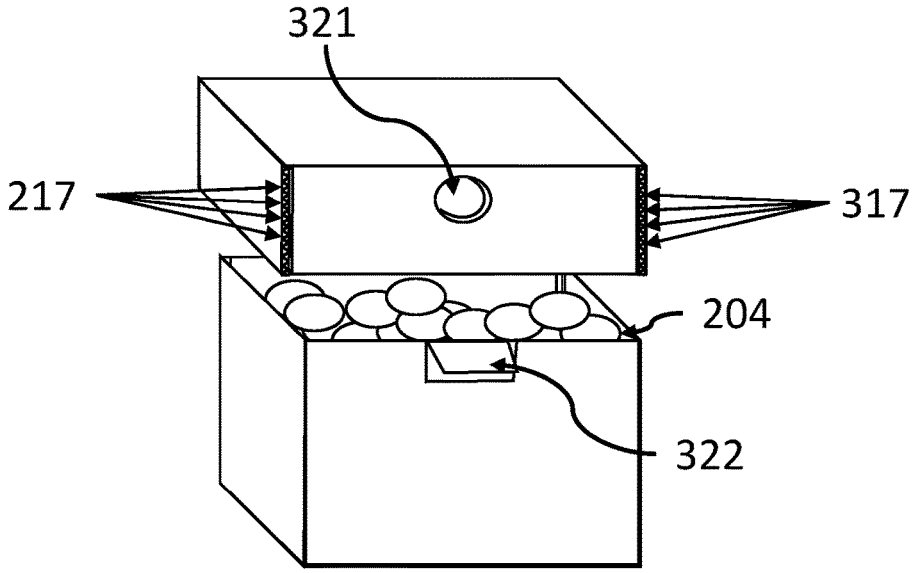
Figure 3A:
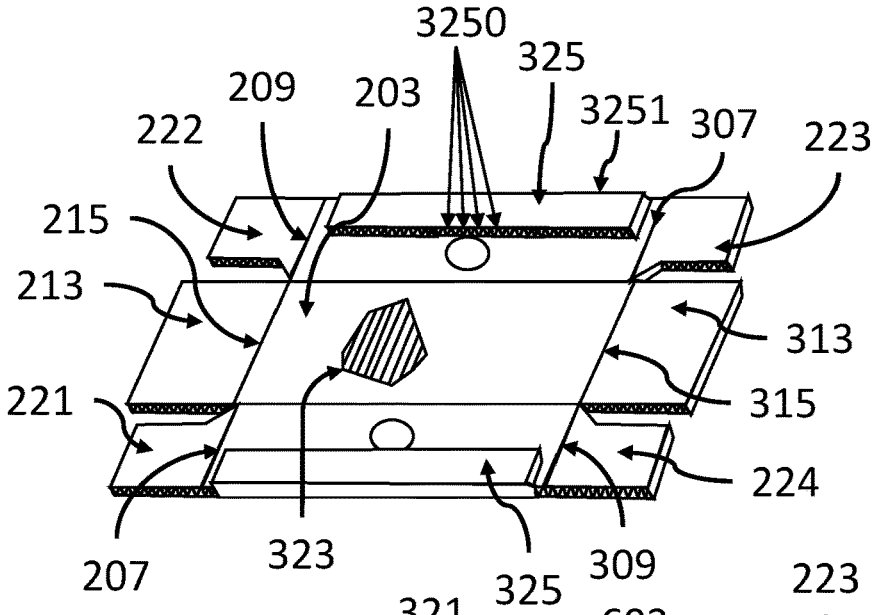
FIG. 3A-D illustrate an example lid of the example consumer product of FIGS. 2A-C.
Figure 3B:
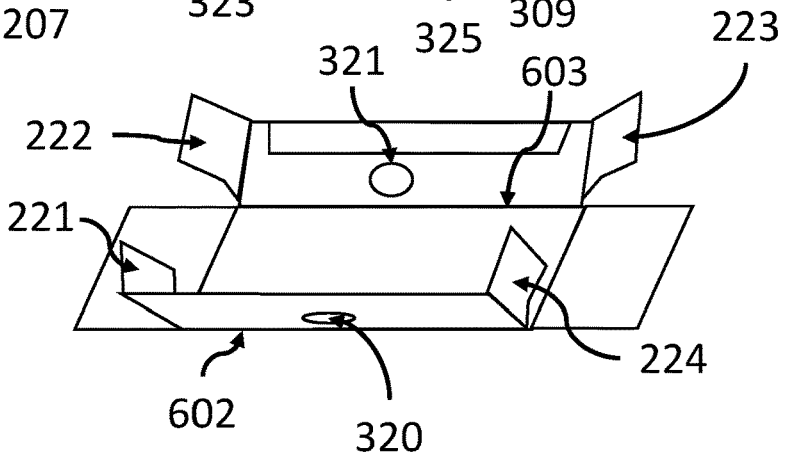
Figure 3C:
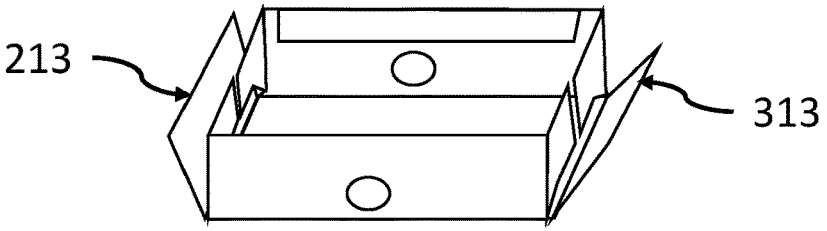

FIGS. 2A-C illustrate another consumer product 200 according to this disclosure. Consumer product 200 is illustrated in FIG. 2A with the lid 201 closed viewed from a front view. Consumer product 200 is illustrated in FIG. 2B with the lid closed viewed from a back view opposite to the front view of FIG. 2A. FIG. 2C illustrates consumer product 200 from the front view of FIG. 2A, with the lid open. FIG. 3A illustrate a blank corresponding to the lid 201 of consumer product 200, such lid 201 being illustrated in FIG. 3D. FIGS. 3B-C illustrate folding steps taking place to turn the blank of FIG. 3A into the lid of FIG. 3D.

Consumer product 200 comprises a detergent product 204, visible in FIG. 2C, and a container, the container containing the detergent product 204, the detergent product preferably comprising water soluble unit dose articles, the container comprising a box 202 and a lid 201, the lid 201 comprising a top panel 203 and flanks, the flanks comprising at least a first flank 205, the first flank 205 corresponding to a first side of the lid from a first flank corner 207 to a second flank corner 209, the first flank corner 207 connecting the first flank 205 with a second flank 206 (visible in FIG. 2B) of the flanks, the second flank corner 209 connecting the first flank 205 with a third flank 211 of the flanks, the first flank 205 comprising a first major flap 213 (also visible in FIG. 3A), the first major flap 213 comprising a first flank corrugated fiberboard layer, the first flank corrugated fiberboard layer being connected by a first flank fold line 215 to the top panel 203, the first flank corrugated fiberboard layer comprising first flank flutes 217, each first flank flute running along a first flank flute length parallel to the first flank fold line, each first flank flute forming a channel in communication with an external environment outside of the lid at a first first flank flute end and at a second first flank flute end.

Figure 3D:
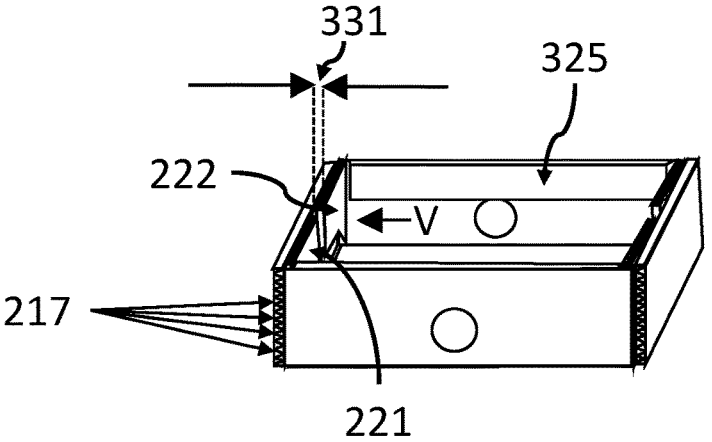

In the example of consumer product 200, first flank 205 comprises an additional first flank corrugated fiberboard layer, the first flank corrugated fiberboard layer being superposed to the additional first flank corrugated fiberboard layer, the additional first flank corrugated fiberboard layer being between the first flank corrugated fiberboard layer and an internal volume of the lid 201, the additional first flank corrugated fiberboard layer comprising a first first flank minor flap 221 extending from the first flank corner 207 and a second first flank minor flap 222 extending from the second flank corner 209, as visible for example on the blank of FIG. 3A or on lid 201 as illustrated on FIG. 3D, the first first flank minor flap 221 covering a first portion of the first side and the second first flank minor flap 222 covering a second portion of the first side, whereby the first first flank minor flap 221 is connected by a fold line, corresponding to the first flank corner 207, to the second flank 206 and whereby the second first flank minor flap is connected by a fold line, corresponding to the second flank corner 209, to the third flank 211.

In this configuration, the first flank comprises two layers. An internal layer comprises the two flank minor flaps 221 and 222 facing each other, such internal layer being covered by an external layer formed by the major flap 213, the major flap being exposed to the external environment, the major flap comprising the flutes 217 in the configuration according to this disclosure in order to effectively protect the flank minor flaps and, therefore, the lid structure, the box and its content.

In the example consumer product 200, the flanks comprise a fourth flank opposite to the first flank 205, the fourth flank corresponding to a second side of the lid from a third flank corner 307 to a fourth flank corner 309, the second side being opposite to the first side, the fourth flank comprising a second major flap 313 visible for example on the blank represented on FIG. 3A, the second major flap 313 comprising a fourth flank corrugated fiberboard layer, the fourth flank corrugated fiberboard layer being connected by a fourth flank fold line 315 to the top panel, the fourth flank corrugated fiberboard layer comprising fourth flank flutes 317, each fourth flank flute running along a fourth flank flute length parallel to the fourth flank fold line 315, each fourth flank flute forming a channel in communication with an external environment outside of the lid at a first fourth flank flute end and at a second fourth flank flute end. The third flank corner 307 connects the fourth flank with the third flank 211, and the fourth flank corner 309 connects the fourth flank with the second flank 206.

In the example consumer product 200, the lid has a symmetrical structure, the structure of the first side of the lid corresponding to a mirrored structure on an opposite second side of the lid.

In the example consumer product 200, the fourth flank comprises an additional fourth flank corrugated fiberboard layer, the fourth flank corrugated fiberboard layer being superposed to the additional fourth flank corrugated fiberboard layer, the additional fourth flank corrugated fiberboard layer being between the fourth flank corrugated fiberboard layer and an internal volume of the lid, the additional fourth flank corrugated fiberboard layer comprising a first fourth flank minor flap 223 extending from the third flank corner 307 and a second fourth flank minor flap 224 extending from the fourth flank corner 309, the first fourth flank minor flap 223 covering a first portion of the second side and the second fourth flank minor flap 224 covering a second portion of the second side, whereby the first fourth flank minor flap 223 is connected by a fold line corresponding to the third flank corner 307 to the third flank and whereby the second fourth flank minor flap 224 is connected by a fold line corresponding to fourth flank corner 309 to the second flank.

In the example consumer product 200, the top panel 203 is a rectangle, the lid 201 comprising two short flanks and two long flanks, whereby the first flank 205 and the fourth flank are short flanks, and whereby the second flank 206 and the third flank 211 are long flanks, preferably whereby one or both of the two long flanks comprises a respective aperture 320 and 321, each respective aperture being a through aperture intersecting flutes comprised in the long flanks. Such aperture permits for example intersecting some flutes of the long flanks, permitting that such flutes be ventilated. It is of particular interest to associate such apertures to the long flanks due to such long flanks having a longer cantilever distance than the short flanks, being thereby more likely to be a cause of weakening of the structure. Such apertures may additionally and further beneficially serve to actuate and provide access to locks such as lock 322 visible on FIG. 2C permitting holding the lid in place. As illustrated for example by the blank of FIG. 3A, the lid 201 may be made from panels and flaps made from a single corrugated fiberboard piece of material having flutes in a single direction as illustrated by cut out 323, which does not correspond to a real cut out but illustrates such flute direction.

In some examples such as example consumer products 100 or 200, both of long flanks 206 and 211 are reinforced, each long flank comprising a main long flank corrugated fiberboard layer and a folded back long flank corrugated fiberboard layer 325. While both long flanks are reinforced in example product 200, a single one or none of the long flanks may be reinforced in other examples. In other examples, none of, a single one of, or both short flanks are also reinforced, each short flank comprising a main short flank corrugated fiberboard layer and a folded back short flank corrugated fiberboard layer. A reinforced structure permits obtaining a sturdier lid. A reinforced structure comprising a folded back layer of corrugated fiberboard layer also permits avoiding exposing a single aperture of a flute to the external environment without providing a ventilation channel from an aperture of a flute to another aperture of the same flute. As illustrated for example in FIGS. 3A-D, a flute of folded back long flank corrugated fiberboard layer 325, following the flute direction illustrated in cut-out 323 which is parallel to first flank fold line 215, would have exposed apertures 3250 which would be directed to an inside of the lid, whereas the distal end 3251 of the corresponding flank would be folded back, thereby preventing exposing the flutes to the external environment and avoiding introducing humidity in the corresponding flutes. A reinforced structure also permits obtaining a stable stack formed of a plurality of blanks whereby such blanks comprise the folded back layer at edges of each such blanks.

Figure 3E:
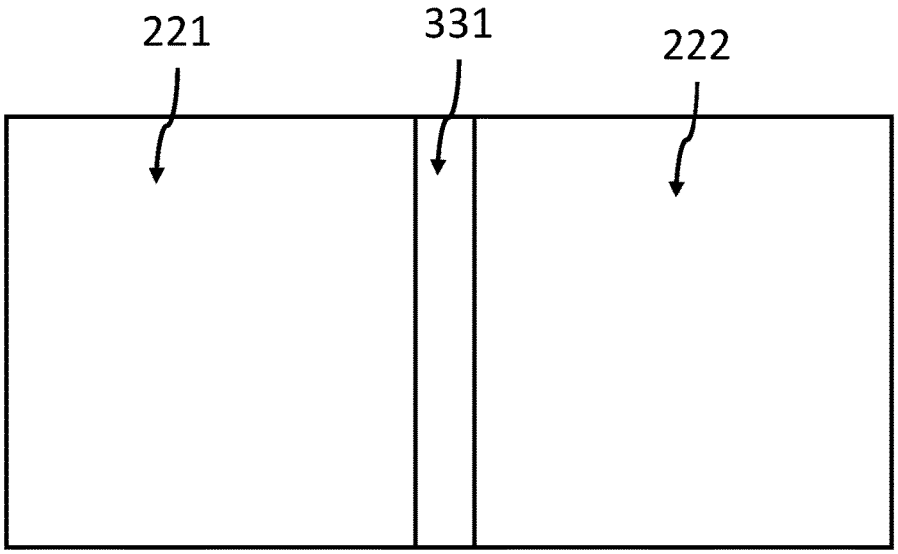
FIG. 3E illustrates a detail of FIG. 3D.

In some examples such as the example consumer product 200, the first portion of the first side and the second portion of the first side are separated by a gap 331 of the first side, the gap 331 of the first side defining a gap surface area of the first side of less than 20%, preferably less than 10%, most preferably less than 5%, of an area covered by the first and second portions of the first side and whereby a combined surface area of the gap of the first side, first and second portions of the first side preferably corresponds to the surface area of the first side. Such first side is illustrated in FIG. 3E viewed along direction V as illustrated in FIG. 3D, whereby the gap 331 is between the first and second first flank minor flaps 221 covering the first portion and 222 covering the second portion of the first side. A smaller gap permits obtaining a sturdier structure, while a larger gap permits saving material.

In the example consumer product 200, the first portion of the second side and the second portion of the second side are separated by a gap of the second side, the gap of the second side defining a gap surface area of the second side of less than 20%, preferably less than 10%, most preferably less than 5%, of an area covered by the first and second portions of the second side and whereby a combined surface area of the gap of the second side, first and second portions of the second side preferably corresponds to the surface area of the second side. While this is not illustrated, such a structure would mirror the structure illustrated in FIG. 3E.

In some examples such as consumer product 200, the first major flap is glued to both of the first and second first flank minor flaps, and the second major flap is glued to both of the first and second fourth flank minor flaps. Such structure permits obtaining sturdy first and fourth flanks. In some examples, the first major flap is heat-sealed to both of the first and second first flank minor flaps, for example using a PE (polyethylene) layer.

In some examples, an outside flank surface is continuous between flank corners, the outside flank surface optionally comprising a water barrier layer. Such a continuous structure between flank corners participates in avoiding moisture entry into the lid structure, while providing ventilation at flute ends as per the present disclosure. In some examples, the outside flank surface comprises a varnish. Possible varnishes include Aquaprint 150, Senolith WB Barrier, Terrawet Barrier, or Terragloss UV barrier, preferably Terragloss UV barriers. These varnishes can help preventing ink from the outside flank surface being transferred towards the detergent product, particularly the water soluble unit dose articles, especially when water soluble unit dose areas have been exposed to higher humidity.

In some examples, the water soluble unit dose articles are flexible water soluble unit dose articles. The structures hereby disclosed are particularly suited for such flexible water soluble unit dose articles which are particularly sensitive to degradation by humidity, and more likely to puncture and contaminate an environment outside of the container, thereby particularly benefiting the use of a ventilated lid according to this disclosure.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol polymer or copolymer, for example a blend of polyvinylalcohol polymers and/or polyvinylalcohol copolymers, for example selected from sulphonated and carboxylated anionic polyvinylalcohol copolymers especially carboxylated anionic polyvinylalcohol copolymers, for example a blend of a polyvinylalcohol homopolymer and a carboxylated anionic polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the detergent product is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

Figure 4:
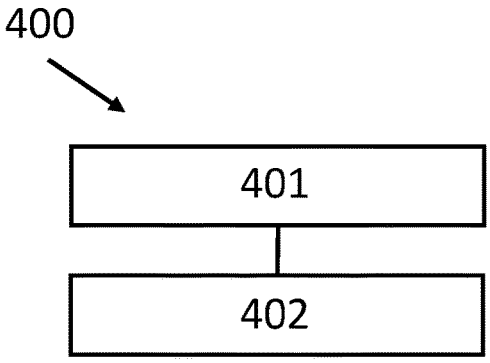
FIG. 4 illustrates a first example method for manufacturing a consumer product.

FIG. 4 illustrates an example method 400 for manufacturing a consumer product according to this disclosure. In a first bloc 401, the method 400 comprises folding the first first flank minor flap 221 and the second first flank minor flap 222 towards each other to form the additional first flank corrugated fiberboard layer as illustrated for example in FIG. 3B. In a second bloc 402, the method 400 comprises folding the first major flap 213 on top of the folded first first flank minor flap 221 and second first flank minor flap 222 as illustrated for example in FIG. 3C in order to form the first flank 205 of the lid 201. Proceeding in this manner ensures that the part of the first flank exposed to the outside, in other words, the first major flap 213, is ventilated by flutes 217 forming a channel in communication with an external environment outside of the lid at a first first flank flute end and at a second first flank flute end.

Figure 5:
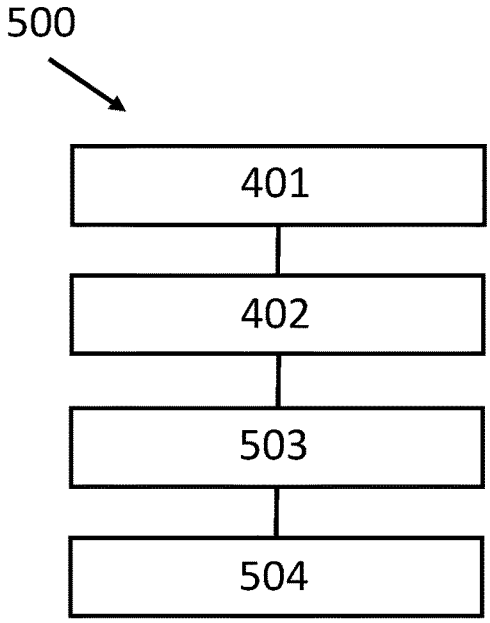
FIG. 5 illustrates a second example method for manufacturing a consumer product.

FIG. 5 illustrates an example method 500 for manufacturing a consumer product according to this disclosure. This method 500 comprises bloc 401 and 402 as described for method 400, and further comprises bloc 503 of folding the first fourth flank minor flap 223 and the second fourth flank minor flap 224 as illustrated in for example FIG. 3B, and bloc 504 of folding the second major flap 313 on top of the folded first fourth flank minor flap 223 and second fourth flank minor flap 224 as illustrated for example in FIG. 3C in order to form the fourth flank of the lid 201.

Figure 6:
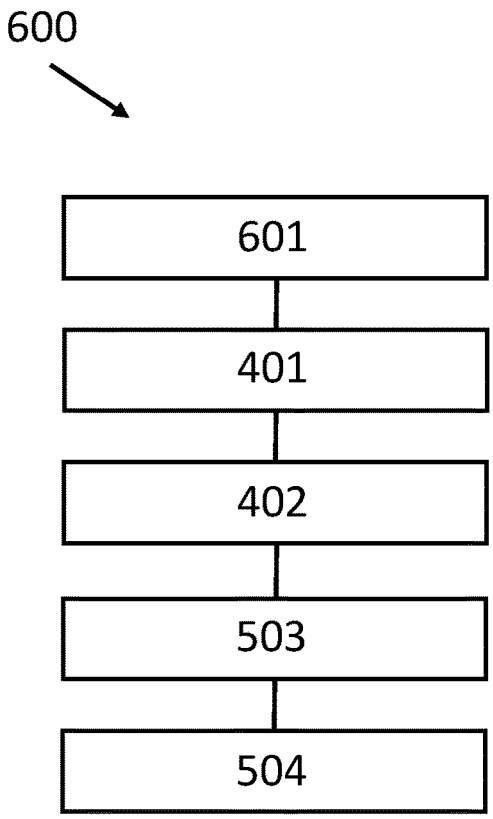
FIG. 6 illustrates a third example method for manufacturing a consumer product.

FIG. 6 illustrates an example method 600 for manufacturing a consumer product according to this disclosure. This method 600 comprises blocs 401, 402, 503 and 504 as described for methods 400 and 500, and further comprises folding second and third flank panels along second and third flank fold lines, for example respectively fold lines 602 and 603 illustrated in FIG. 3B to form the second 206 and third 211 flanks prior to folding the minor flaps 221-224. This permits obtaining the second and third flanks as illustrated for example in FIG. 3B.

Figure 7:
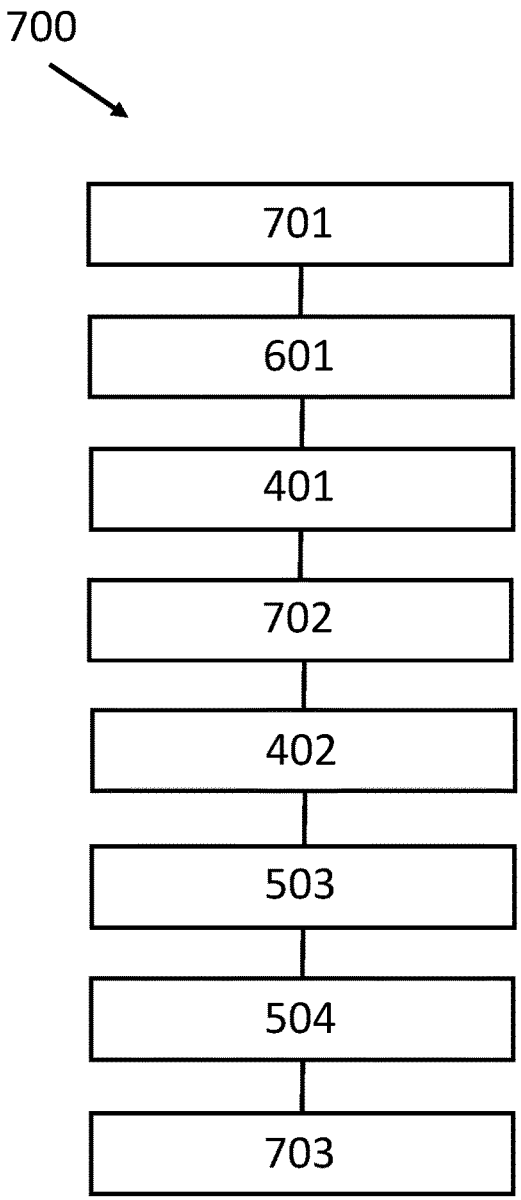
FIG. 7 illustrates a fourth example method for manufacturing a consumer product.

FIG. 7 illustrates an example method 700 for manufacturing a consumer product according to this disclosure. This method 700 comprises blocs 401, 402, 503, 504 and 601 as described for methods 400, 500 and 600, and further comprises in bloc 701 applying glue to the first major flap 213 prior to folding the first major flap 213 on top of the folded first first flank flap 221 and folded second first flank minor flap 222, and gluing the first major flap 213 on top of the folded first first flank minor flap 221 and folded second first flank minor flap 222 as illustrated in bloc 702 when folding the first major flap 213 on top of the folded first first flank minor flap 221 and folded second first flank minor flap 222 as per bloc 402; and placing the lid on the box comprising the detergent product as illustrated in bloc 703.

Figure 8:
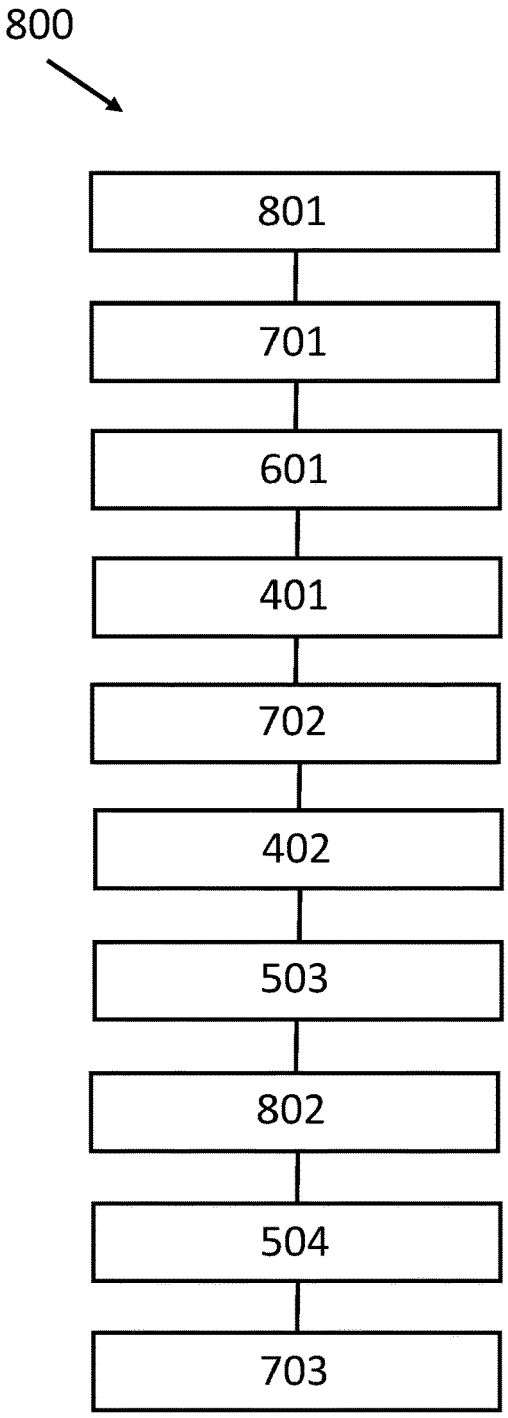
FIG. 8 illustrates a fifth example method for manufacturing a consumer product.

FIG. 8 illustrates an example method 800 for manufacturing a consumer product according to this disclosure. This method 800 comprises blocs 401, 402, 503, 504, 601, 701, 702 and 703 as described for methods 400, 500, 600 and 700, and further comprises in bloc 801 applying glue to the second major flap prior to folding the second major flap on top of the folded first fourth flank minor flap and folded second fourth flank minor flap, and, in bloc 802, gluing the second major flap on top of the folded first fourth flank minor flap and folded second fourth flank minor flap when folding the second major flap on top of the folded first fourth flank minor flap and folded second fourth flank minor flap as illustrated in bloc 504.

Figure 9:
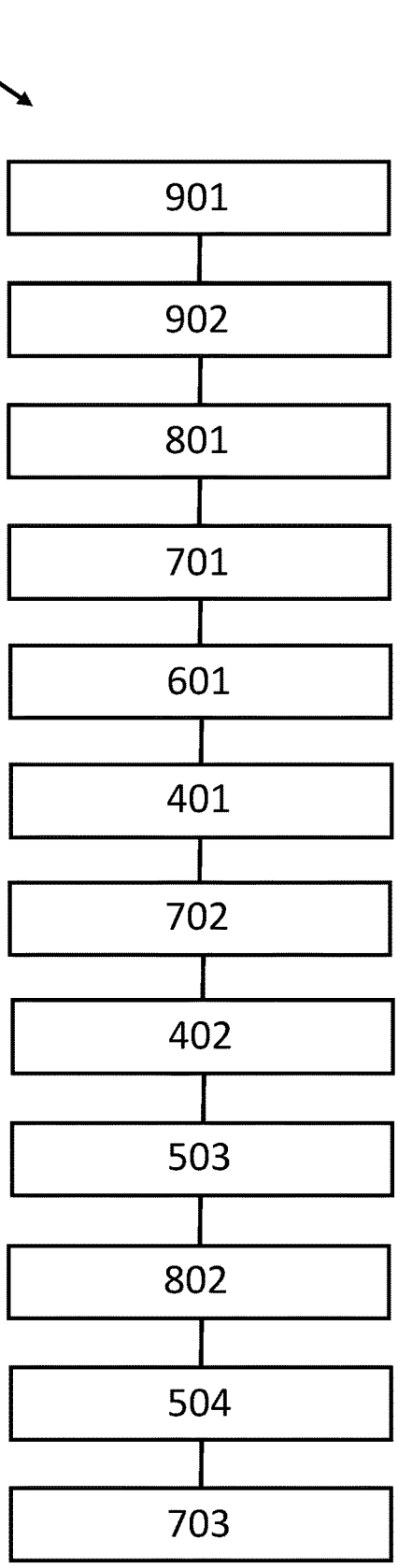
FIG. 9 illustrates a sixth example method for manufacturing a consumer product.

FIG. 9 illustrates an example method 900 for manufacturing a consumer product according to this disclosure. This method 900 comprises blocs 401, 402, 503, 504, 601, 701, 702, 703, 801 and 802 as described for methods 400, 500, 600, 700 and 800, and further comprises in bloc 901 forming one or more reinforced long flanks by folding and gluing folded back long flank corrugated fiberboard layers onto main long flank corrugated fiberboard layers, and in bloc 902 forming one or more reinforced short flanks by folding and gluing folded back short flank corrugated fiberboard layers onto main short flank corrugated fiberboard layers.

It should be noted that some blocs in the illustrated methods may be ordered or recombined in order to build alternative example methods.

Figure 10:
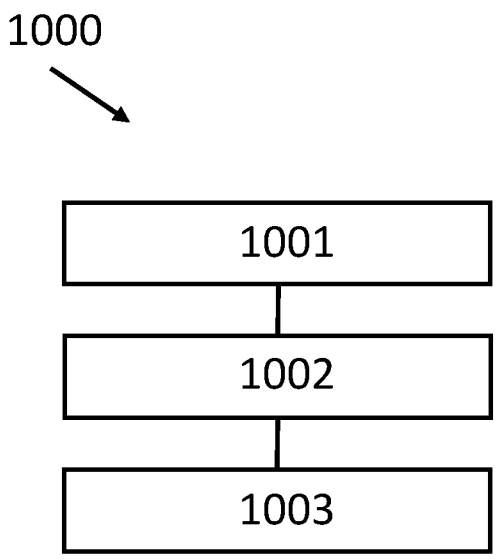
FIG. 10 illustrates an example method to protect a detergent product from an external environment.

FIG. 10 illustrates an example method 1000 to protect a detergent product from an external environment, the method 1000 comprising, in bloc 1001, placing the detergent product 204 in a container according to this disclosure, closing the lid as per bloc 1002, and limiting entry of humidity or water from the external environment into the container by using flutes forming a channel in communication with the external environment outside of the lid from a flute end to another flute end as per bloc 1003. This indeed permits ventilating at least a first flank of the lid according to this disclosure. This method may be combined with any of example methods 400, 500, 600, 700, 800 or 900 as previously described.

Figure 11:
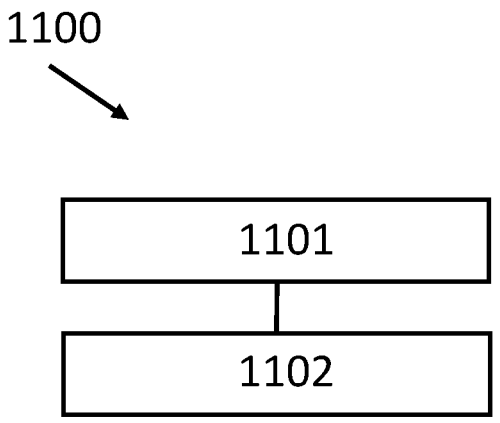
FIG. 11 illustrates an example method to dismount a container.

FIG. 11 illustrates an example method 1100 to dismount a container according to this disclosure, method 1100 comprising, in bloc 1101, pulling the first major flap to disconnect the first flank from other flanks, and, in bloc 1102, pulling the second major flap to disconnect the fourth flank from the other flanks. The configuration of such major flanks indeed offers an improved gripping surface to a user aiming at dismantling the lid in order to flatten its structure and recycle it. This method may be combined with any of example methods 400, 500, 600, 700, 800, 900 or 1000 as previously described.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a detergent product and a container, the container containing the detergent product, the container comprising a box and a lid, the lid comprising a top panel and flanks, the flanks comprising at least a first flank, the first flank corresponding to a first side of the lid from a first flank corner to a second flank corner, the first flank corner connecting the first flank with a second flank of the flanks, the second flank corner connecting the first flank with a third flank of the flanks, the first flank comprising a first major flap, the first major flap comprising a first flank corrugated fiberboard layer, the first flank corrugated fiberboard layer being connected by a first flank fold line to the top panel, the first flank corrugated fiberboard layer comprising first flank flutes, each first flank flute running along a first flank flute length parallel to the first flank fold line, each first flank flute forming a channel in communication with an external environment outside of the lid at a first first flank flute end and at a second first flank flute end.

2. The consumer product according to claim 1, wherein the detergent product comprises water soluble unit dose articles.

3. The consumer product according to claim 1, wherein the flanks comprise a fourth flank opposite to the first flank, the fourth flank corresponding to a second side of the lid from a third flank corner to a fourth flank corner, the second side being opposite to the first side, the fourth flank comprising a second major flap, the second major flap comprising a fourth flank corrugated fiberboard layer, the fourth flank corrugated fiberboard layer being connected by a fourth flank fold line to the top panel, the fourth flank corrugated fiberboard layer comprising fourth flank flutes, each fourth flank flute running along a fourth flank flute length parallel to the fourth flank fold line, each fourth flank flute forming a channel in communication with an external environment outside of the lid at a first fourth flank flute end and at a second fourth flank flute end.

4. The consumer product according to claim 3, wherein the fourth flank comprises an additional fourth flank corrugated fiberboard layer, the fourth flank corrugated fiberboard layer being superposed to the additional fourth flank corrugated fiberboard layer, the additional fourth flank corrugated fiberboard layer being between the fourth flank corrugated fiberboard layer and an internal volume of the lid, the additional fourth flank corrugated fiberboard layer comprising a first fourth flank minor flap extending from the third flank corner and a second fourth flank minor flap extending from the fourth flank corner, the first fourth flank minor flap covering a first portion of the second side and the second fourth flank minor flap covering a second portion of the second side, whereby the first fourth flank minor flap is connected by a fold line to the third flank and whereby the second fourth flank minor flap is connected by a fold line to the second flank.

5. The consumer product according to claim 4, wherein the first portion of the second side and the second portion of the second side are separated by a gap of the second side, the gap of the second side defining a gap surface area of the second side of less than about 20%, of an area covered by the first and second portions of the second side.

6. The consumer product according to claim 4, wherein the second major flap is glued to both of the first and second fourth flank minor flaps.

7. The consumer product according to claim 4, wherein an outside flank surface is continuous between flank corners, the outside flank surface.

8. The consumer product according to claim 1, wherein the top panel is a rectangle, the lid comprising two short flanks and two long flanks, whereby the first flank and the fourth flank are short flanks, and whereby the second flank and the third flank are long flanks.

9. The consumer product according to claim 8, wherein one or both of the long flanks are reinforced, wherein each reinforced long flank comprises a main long flank corrugated fiberboard layer and a folded back long flank corrugated fiberboard layer.

10. The consumer product according to claim 1, wherein the detergent product comprises flexible water soluble unit dose articles.

11. The consumer product according to claim 1, wherein the first flank comprises an additional first flank corrugated fiberboard layer, the first flank corrugated fiberboard layer being superposed to the additional first flank corrugated fiberboard layer, the additional first flank corrugated fiberboard layer being between the first flank corrugated fiberboard layer and an internal volume of the lid, the additional first flank corrugated fiberboard layer comprising a first first flank minor flap extending from the first flank corner and a second first flank minor flap extending from the second flank corner, the first first flank minor flap covering a first portion of the first side and the second first flank minor flap covering a second portion of the first side, wherein the first first flank minor flap is connected by a fold line to the second flank and wherein the second first flank minor flap is connected by a fold line to the third flank.

12. The consumer product according to claim 11, wherein the first portion of the first side and the second portion of the first side are separated by a gap of the first side, the gap of the first side defining a gap surface area of the first side of less than about 20%, of an area covered by the first and second portions of the first side.

13. The consumer product according to claim 11, wherein the first major flap is glued to both of the first and second first flank minor flaps.

14. A method for manufacturing a consumer product according to claim 11, the method comprising:

folding the first first flank minor flap and the second first flank minor flap towards each other to form the additional first flank corrugated fiberboard layer; and folding the first major flap on top of the folded first first flank minor flap and second first flank minor flap in order to form the first flank of the lid.

15. The method according to claim 14 comprising:

folding the first fourth flank minor flap and the second fourth flank minor flap; and folding the second major flap on top of the folded first fourth flank minor flap and second fourth flank minor flap in order to form the fourth flank of the lid.

16. The method according to any of claim 14, the method comprising:

folding second and third flank panels along second and third flank fold lines to form the second and third flanks prior to folding the minor flaps.

17. The method according to any of claim 14 further comprising:

applying glue to the first major flap prior to folding the first major flap on top of the folded first first flank minor flap and folded second first flank minor flap;

gluing the first major flap on top of the folded first first flank minor flap and folded second first flank minor flap when folding the first major flap on top of the folded first first flank minor flap and folded second first flank minor flap; and placing the lid on the box comprising the detergent product.

18. The method according to any of claim 15 further comprising:

applying glue to the second major flap prior to folding the second major flap on top of the folded first fourth flank minor flap and folded second fourth flank minor flap;

gluing the second major flap on top of the folded first fourth flank minor flap and folded second fourth flank minor flap when folding the second major flap on top of the folded first fourth flank minor flap and folded second fourth flank minor flap.

19. The method according to any of claim 14, the flanks comprising two short flanks and two long flanks, whereby one or both of the long flanks are reinforced, the method comprising:

forming the one or both of reinforced long flanks by folding and gluing folded back long flank corrugated fiberboard layers onto main long flank corrugated fiberboard layers.

20. A method to protect a detergent product from an external environment, the method comprising:

placing the detergent product in a container of a consumer product according to claim 1;

closing the lid; and limiting entry of humidity or water from the external environment into the container by using flutes forming a channel in communication with the external environment outside of the lid from a flute end to another flute end.

21. A method to dismount a container of a consumer product according to claim 1, the method comprising pulling the first major flap to disconnect the first flank from other flanks.

* * * * *